United States Patent [19]

Anderson et al.

[11] Patent Number: 4,484,528

[45] Date of Patent: Nov. 27, 1984

[54] RAILWAY HOPPER CAR

[75] Inventors: Arthur I. Anderson, St. Paul; Louis J. Harvatin, Minneapolis, both of Minn.

[73] Assignee: North American Car Corporation, Chicago, Ill.

[21] Appl. No.: 310,056

[22] Filed: Oct. 9, 1981

[51] Int. Cl.[3] ..... B61D 5/00; B61D 7/00; B61D 17/08

[52] U.S. Cl. ..... 105/248; 105/358; 105/377; 105/409

[58] Field of Search ..... 105/247, 248, 358, 360, 105/377, 409

[56] References Cited

U.S. PATENT DOCUMENTS

| | | | |
|---|---|---|---|
| 651,795 | 6/1900 | Coolbaugh et al. | 105/247 |
| 863,615 | 8/1907 | Levy | 105/247 |
| 3,277,843 | 10/1966 | Horner et al. | 105/360 |
| 3,339,499 | 9/1967 | Charles et al. | 105/360 X |
| 3,470,829 | 10/1969 | Szała | 105/248 |
| 3,490,387 | 1/1970 | Halcomb | 105/248 |
| 3,543,692 | 12/1970 | Stark et al. | 105/248 |
| 3,583,331 | 6/1971 | Mowatt-Larssen | 105/248 X |
| 4,003,319 | 1/1977 | Campbell et al. | 105/360 X |
| 4,168,665 | 9/1979 | Needham et al. | 105/248 X |
| 4,230,048 | 10/1980 | Gordon et al. | 105/248 |
| 4,292,898 | 10/1981 | Gordon et al. | 105/248 X |
| 4,352,331 | 10/1982 | Anderson et al. | 105/358 X |

FOREIGN PATENT DOCUMENTS

| | | | |
|---|---|---|---|
| 2059339 | 6/1971 | Fed. Rep. of Germany | 105/248 |

*Primary Examiner*—Howard Beltran

*Attorney, Agent, or Firm*—Lockwood, Dewey, Alex & Cummings

[57] ABSTRACT

A covered railway hopper car includes side walls comprising upper arcuate side sheet and lower flat inclined side sheet portions. The upper edge of the flat side sheet is bent to form a longeron which extends intermediate the height of the side wall and which is attached adjacent the lower edge of the arcuate side wall. A side sill extends longitudinally on the exterior of the flat side sheet to form, together with the longeron, reinforcement for the side walls. The car also includes an end structure comprising a vertical plate extending upwardly into support of the end slope walls of the car at a location intermediate the length of the end slope walls and a vertical support of the interior of the wall above the plate to distribute forces directly from the center plate of the car to the roof at a location spaced from the vertical end walls of the car.

24 Claims, 4 Drawing Figures

RAILWAY HOPPER CAR

BACKGROUND AND SUMMARY OF THE INVENTION

The present invention relates to a covered railway hopper car.

In the past, covered hopper cars have been of two general forms. One such form of car has been constructed of substantially vertical flat side walls. Such flat sided cars have had the disadvantage that, although the volumetric capacity of the car is maximized due to their flatness, reinforcing side posts as well as end structures of considerable weight and complexity are necessary to reinforce the side walls and to transmit the forces encountered by the car to the roof of the car, respectively. This is due to the fact that a flat side walled car is essentially the weakest form from a structural standpoint and, without such support members, it is unable to withstand the loads imposed on the car walls by the lading and during transit. Moreover, such flat side walled cars are generally incapable of pressure or vacuum unloading due to the substantial pressure differentials which are experienced. Indeed, where external vertical support posts have been provided in such flat walled cars, the volumetric capacity increase which might otherwise be realized in such cars is lost due to the need for positioning the flat side walls within the maximum dimensional tolerances required by prevailing railway standards in order to accommodate the thickness of the external vertical supports.

In order to overcome some of these disadvantages of the flat side walled hopper cars, the second form of such car was developed. These are cars which have arcuate side walls. The arcuate side walled cars overcame some of the above-mentioned disadvantages in varying degree. Where the arcuate curvature of the side walls was only sufficiently arcuate, i.e. of substantially large radius, to overcome the need for the side vertical posts necessary in the flat walled cars, the capacity of the cars was increased by elimination of the support posts. However, end support structures of substantial weight and detail were still necessary to distribute the forces encountered by the car. Moreover, even though these hopper cars with large radii of curvature overcame the need for external support posts, they still did not possess sufficient strength to allow for unloading techniques other than simple gravity unloading, i.e. they were incapable of withstanding the substantial pressure differentials encountered in vacuum or pneumatic unloading. If the degree of curvature in these prior arcuate side walled cars was increased by an amount sufficient to enable elimination of end support structures of substantial weight and comlexity and/or to provide for vacuum or pressure unloading, the degree of curvature, i.e. the radius of curvature, had to be shortened to such extent that substantial volumetric capacity of the car was sacrificed.

In the covered hopper car of the present invention, each of the several above-mentioned disadvantages has been avoided and, yet, the volume of the car has been maximized, the weight of the car has been minimized and the cost and ease of assembly and production of the car has been improved. In a car incorporating the principles of the present invention, an end structure has been incorporated into the car which is substantially simpler, lighter and less expensive than the prior end structures, but just as or more effectively distributes the forces exerted on the car directly to the roof of the car. In a hopper car incorporating the principles of the present invention, substantial and additional reinforcement of the side walls of the car over its longitudinal length is realized, allowing the maximum radius of curvature of the arcuate side walls of such car and maximum capacity of the car and, even though the capacity of the car is maximized, either gravity, pneumatic or vacuum unloading techniques may be employed. Moreover, unloading of the covered hopper car incorporating the principles of the present invention is improved over the prior arcuate side walled cars, whatever method of unloading is employed.

In one principal aspect of the present invention, a covered railway hopper car comprises side walls each of which includes a first arcuate sheet portion which extends longitudinally of the car and which has upper and lower boundaries, and a second side sheet portion, which defines the bottom of the side walls, and which also extends longitudinally of the car and is substantially flatter in cross section than the first arcuate side sheet portion. The second side sheet portion also has upper and lower boundaries and is positioned beneath and secured adjacent its upper boundary to the first arcuate side sheet portion adjacent the lower boundary of the latter. A roof covers the car and is secured to the first arcuate side sheet portion adjacent its upper boundary, and a reinforcing member extends longitudinally of the car and reinforces at least one of these side sheet portions.

In another principal aspect of the present invention in the covered hopper car just described, the reinforcing member includes a longitudinally, continuously extending longeron intermediate the upper and lower boundaries of the said sheet portions. This longeron is secured to the side sheet portions at a location adjacent the location at which the side sheet portions are respectively secured to each other. The reinforcing member also includes a side sill which extends substantially continuously and longitudinally over the length of the car and is secured to the second side sheet portion between its upper and lower boundaries to further reinforce the car.

In still another principal aspect of the present invention, an improved end support structure for a covered railway hopper car includes a first vertical support which extends vertically between and which is secured to the shear plate of the car and the end slope wall in a plane located intermediate the top of the end slope wall and the location where the plane of the horizontal shear plate intersects the end slope wall. A second vertical support extends upwardly adjacent that vertical plane between the end slope sheet and the roof of the car to transmit forces substantially in that vertical plane directly to the roof at a location spaced from the vertical end wall.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENT

Figure 1:
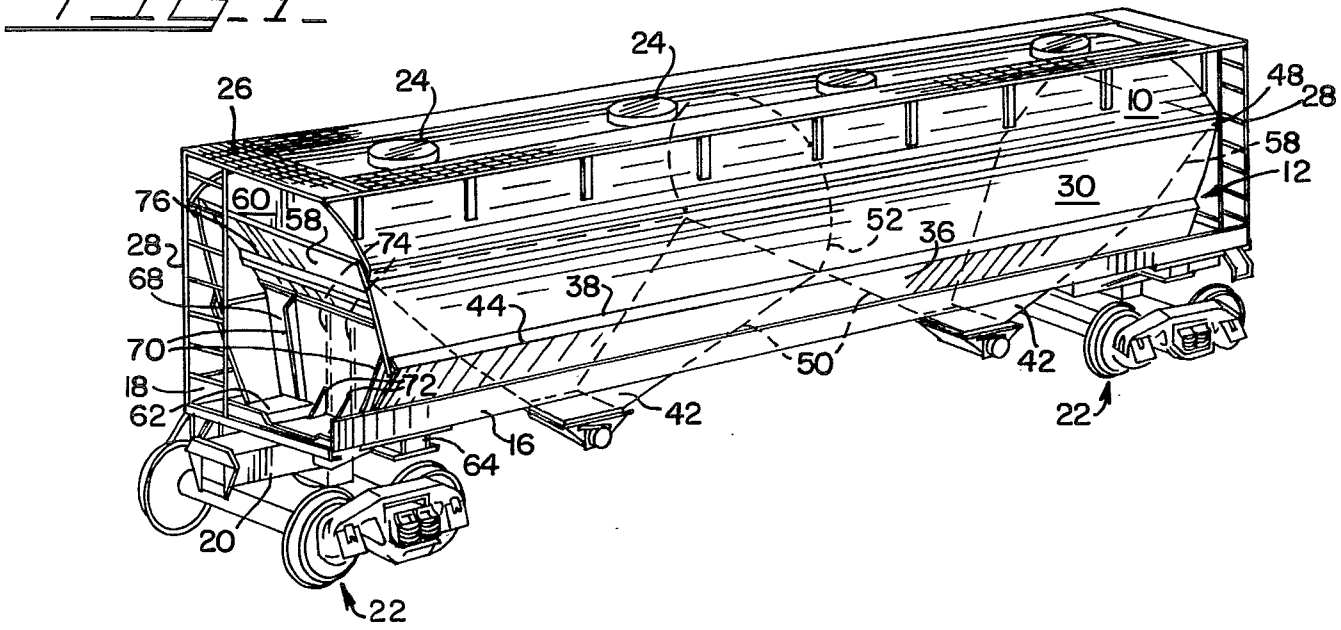
FIG. 1 is an overall perspective view of a covered railway hopper car incorporating the principles of the present invention.

A covered railway hopper car constructed in accordance with the principles of the present invention is shown in the drawings. The car, as shown particularly in FIGS. 1 and 3, generally includes an arcuate roof 10, a pair of side walls 12 and 14, a pair of side sills 16 and 18, a stub sill 20 at each end of the car to which a suitable coupling (not shown) for coupling the cars to the next adjacent cars is mounted, and a pair of standard railway trucks 22 at each end of the car.

The roof 10 includes a plurality of access hatches 24 or, in the alternative, a long hatch extending the length of the car might be provided as is commonly found on such cars. A suitable walkway 26 and ladders 28 for accessing the walkway are also mounted to the car. The ladders 28 are shown in FIG. 1 only and have been removed from the remaining figures for the purposes of clarity.

The side walls 12 and 14 each comprise two distinct portions, an arcuate side sheet 30 which extends longitudinally of the car and which has upper and lower boundaries defined by edges 32 and 34, respectively, and a flat inclined second sheet 36, which also has upper and lower boundaries defined by edges 38 and 40, respectively. The lower edge 34 of the arcuate side sheet 30 is secured, as by welding, adjacent the upper edge 38 of the flat side sheet 36. The lower edge 40 of the flat side sheet 36 is also secured, such as by welding, to intermittent hopper side slope sheets 42 for completing the individual hoppers.

Figure 2:
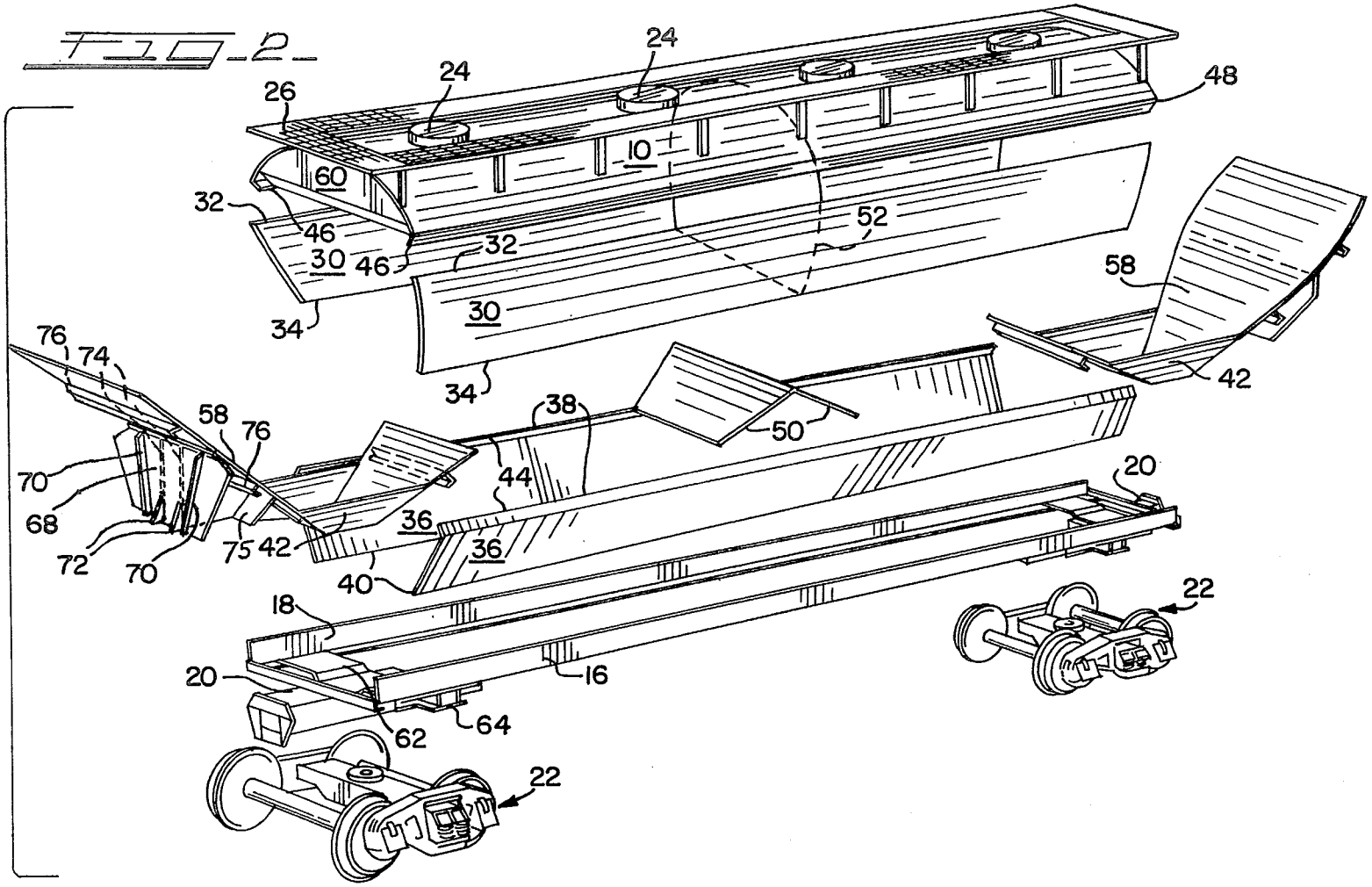
FIG. 2 is an exploded view of the covered railway hopper car shown in FIG. 1 showing its several components.
Figure 3:
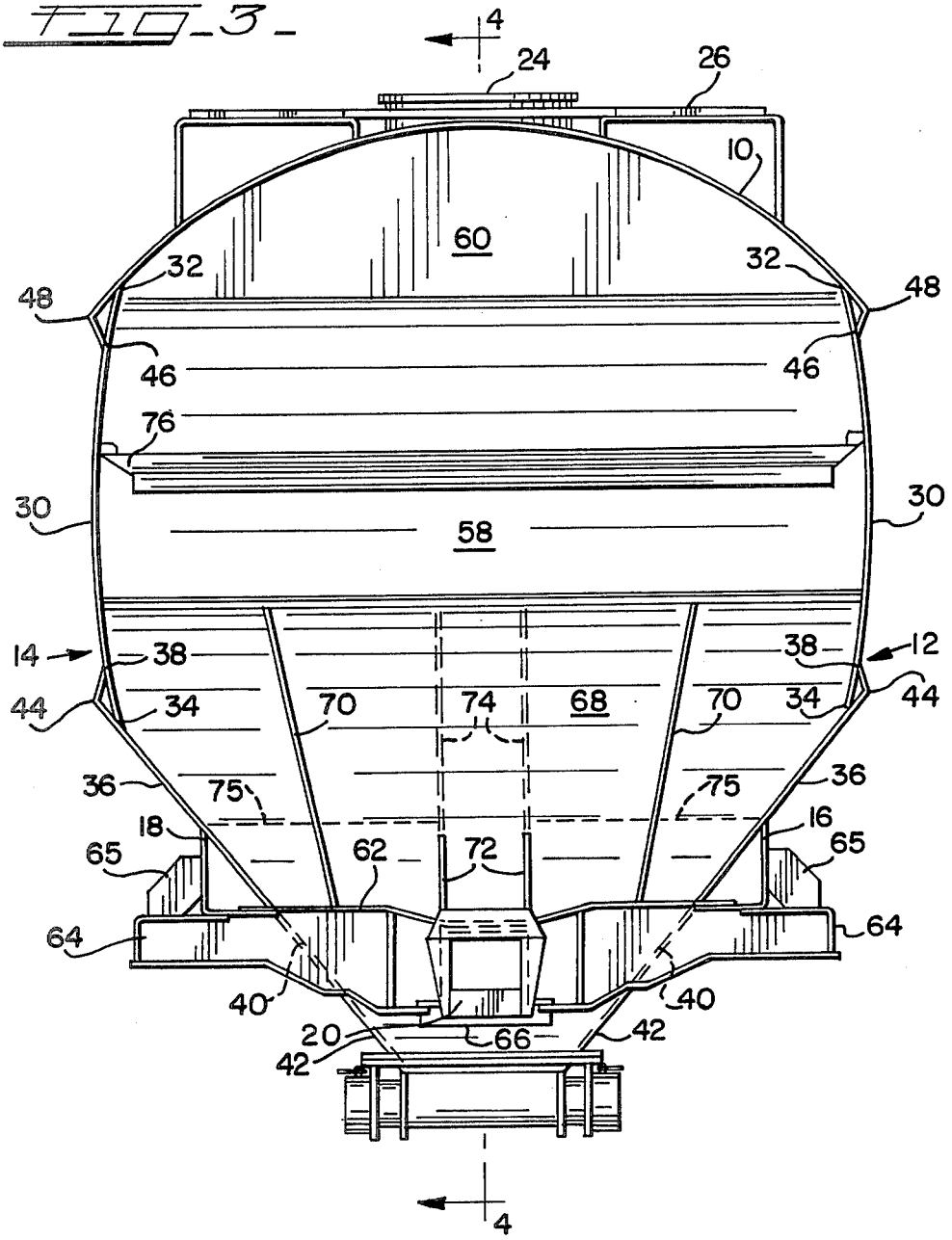
FIG. 3 is an end view of the covered railway hopper car shown in FIG. 1.

The upper edge 38 of the flat side sheet 36 is bent backward, as shown particularly in FIGS. 1–3, to form an elongate reinforcing longeron 44 which runs the length of the car intermediate the height of the side walls 12 and 14. The bottom edge 40 of the flat side wall 36 terminates beneath the side sills 16 and 18, as shown particularly in FIG. 3, such that the side sills also reinforce the flat side walls intermediate their height. The upper edge 38 of the bent back portion of the flat side wall 36 is also secured, such as by welding, to the arcuate side sheets adjacent their lower edges 34 to form the longeron 44.

The upper edges 32 of the arcuate side walls 30 are secured, as by welding, to the roof 10, as particularly shown in FIG. 3. The overhanging edges of the roof 10 are also bent backward and the bent back edges 46 are attached, as by welding, to the upper part of the arcuate side sheets 30 adjacent their upper edges 32. Thus, the bent back portion of the roof 10 also forms top longeron 48 adjacent the roof of the car and which extend longitudinally of the car to further reinforce the car.

The covered hopper car shown in the drawings has two hoppers. However, it will be understood that the principles of the invention are not only applicable to cars having two hoppers, but are equally pertinent to cars having more than two hoppers.

Figure 4:
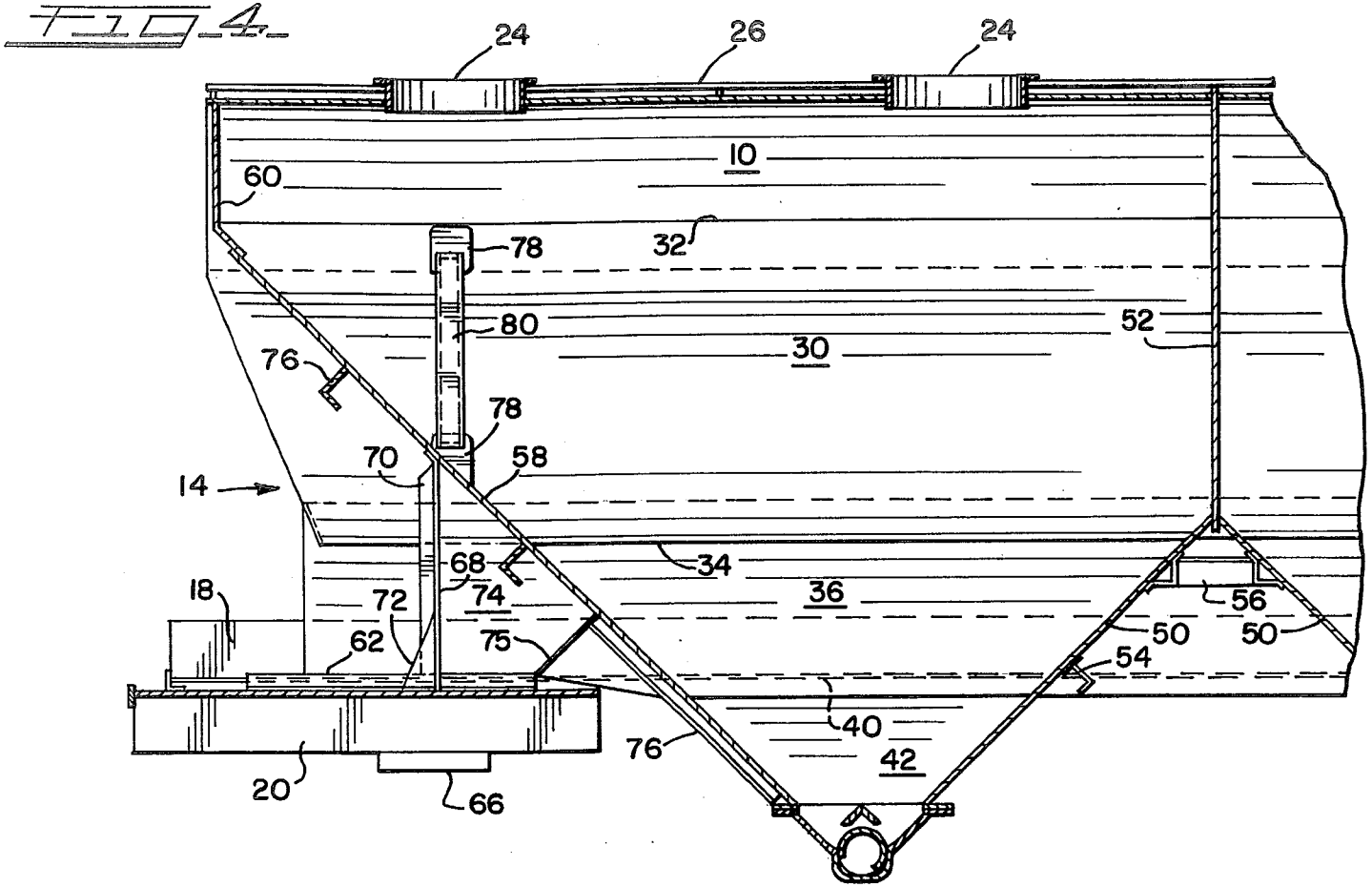
FIG. 4 is a partially broken, cross-sectioned side elevational view of the covered hopper car as viewed substantially along lines 4—4 of FIG. 3.

In the car shown, the hoppers comprise a pair of sloped intermediate walls 50 which meet in an apex where they join a vertical strengthening wall 52 within the car. The wall 52 need not be a solid wall, but may have lightening holes (not shown), if desired. Suitable stiffening bars 54 and bridges 56 may be incorporated into the intermediate walls and at their apex to reinforce the car as necessary as shown in FIG. 4.

The ends of the hoppers adjacent the ends of the car are completed by end slope walls 58 which extend upward from the bottoms of the hoppers to a point where they are secured, as by welding, at their tops to vertical end walls 60 at the ends of the car.

As is conventional in covered railway hopper cars, the preferred car of the present invention, as previously mentioned, includes a stub sill 20 which extends from each end of the car backward to a point adjacent the end slope walls 58. The stub sill 20 is carried upon a generally planar shear plate 62 which extends horizontally across the width of the car. The shear plate 62 is secured to the side sills 16 and 18 at each side of the car. Beneath the shear plate, a jacking beam 64 preferably extends transversely outwardly of the car to facilitate jacking of the car for truck repair or removal. Gussets 65, as shown in FIG. 3, preferably extend between the jacking beam 64 and the side sills 16 and 18 for reinforcement. The trucks 22, in turn, pivot about a center plate 66 mounted beneath the stub sill, the latter of which is mounted to the shear plate 62. Thus far, the end structure which has been described is essentially conventional.

In the preferred embodiment of the car of the present invention, the end reinforcing structure effects a substantial reduction in the weight and complexity over those of the prior cars. In the preferred car of the present invention, a vertical support plate 68 extends across the width of the car and is secured, as by welding, at its bottom edge to the horizontal shear plate 62 and at its upper edge to a location on the exterior of the end slope wall 58 intermediate the top of the end slope wall and a location on the end slope wall at which the plane of the horizontal shear plate 62 intersects the end slope wall 58. The vertical support plate 68 preferably includes one or more stiffener bars 70 and stiffening gussets 72 on its exterior.

In addition, a pair of triangular shaped enlarged gussets 74 extend rearwardly and longitudinally of the car and are attached, as by welding, to the shear plate 62, the rear side of the vertical support plate 68 and the exterior of the end slope wall 58. The inner ends of gussets 74 are cut off and inclined plates 75, as are shown in FIGS. 2 and 4, are secured, as by welding, to the gussets 74 and shear plate 62. Plates 75 extend outwardly from each of the gussets 74 and are welded to the inside of the flat side sheets 36. Thus, the vertical support 68, gussets 74, side sheets 36 and inclined plate 75 together with the shear plate 62 and end slope wall 58 form a torsion box for absorbing forces exerted on the end of the car. As shown in FIGS. 2–4, additional stiffening bars 76 may also be provided on the end slope wall, if necessary.

The vertical support plate 68 is also secured, as by welding, at its edges to the lower portion of the arcuate side walls 30 and flat side walls 36. Plate 68 is positioned substantially directly over the center plate 66. Thus, forces passing upwardly through the center plate from the trucks 22 will be transmitted in a vertical plane upwardly by plate 68 to the intermediate point of attachment of that plate at the end slope wall 58. These forces are then directly vertically transmitted to the roof 10 and roof longerons 48 by suitable pads 78 and vertical support members 80 as shown in FIG. 4. Thus, the vertical support plate 68 and vertical supports 80 directly transmit forces from the center plate 66 to the roof 10 via the shortest possible path and eliminate the need for extensive and bulky gussets to reinforce the ends of the car. In addition, it will be noted, when viewing FIGS. 1 and 4, that the arcuate side sheets 30 and flat sheets 36 do not terminate at the end slope wall 58, but continue further longitudinally toward the end of the car and toward the plane defined by the vertical end walls 60. It has been found that such further extension of these walls assists in transferring the forces imparted to the ends of the car directly to the roof of the car through the car side walls without any substantial increase in weight of the car.

In addition to the substantial reinforcement realized by the end construction just described, the combination of the arcuate and flat side sheets 30 and 36 and their juxtapositioning relative to each other and to the other structural elements of the car results in a substantial increase in strength without an accompanying loss of volumetric capacity or increase in car weight. These advantages are the result of several features of the side wall construction of the car previously described.

One such feature is the use of the combined arcuate and inclined flat side walls 30 and 36. By limiting the height of the arcuate side walls 30, they are not only easier to manufacture because they require less rolling than the prior top-to-bottom side walls and are easier to handle during assembly, but the degree of curvature may be substantially flattened, i.e. the radius of curvature increased, and yet allow these walls to withstand the extreme pressure differentials encountered during pressure or vacuum unloading. Surprisingly, radii of curvature on the order of as large as about 160 inches may be employed and yet pressure and vacuum unloading techniques may still be used. This is because of the presence of the reinforcing longerons 44 which extend the length of the car intermediate the height of the side walls 12 and 14 and which reinforce the car side walls. Additional reinforcement of the car side walls is also effected by the top longerons 48. It will be noted, however, that by virtue of the construction of longerons 44 and 48, they are still positioned within the maximum dimensional confines of the car as defined by the maximum outward curvature of the arcuate walls 30. Thus, external reinforcement of the side walls is provided without any loss of volumetric capacity of the car.

It will also be observed that, although the flat side sheets 36 present the maximum car capacity but the minimum ability to withstand damage due to lading weight and pressure differentials which might be encountered during pressure or vacuum unloading conditions, they are also reinforced against damage or distortion by the side sills 16 and 18 which are positioned along the length of the flat side sheet 36 at a location intermediate the top and bottom edges 38 and 40 of the flat side sheets.

Moreover, the side longeron construction 44 not only reinforces the car intermediate its side wall height, but it also facilitates alignment of the arcuate and flat side sheets 30 and 36 during assembly.

Another advantage of the combined arcuate and flat side sheets 30 and 36 is that the flat side sheets provide a steeper angle of incline adjacent the bottom of the car to facilitate in the complete discharge of the lading during the unloading of the car.

It will be understood that the embodiment of the present invention which has been described is merely illustrative of an application of the principles of the invention. Other modifications may be made by those skilled in the art without departing from the spirit and scope of the invention.

What is claimed is:

1. A covered railway hopper car comprising:

side walls on opposite sides of the car and having a top and a bottom, said side walls each including, a first arcuate side sheet portion extending longitudinally of the car and having upper and lower boundaries also extending longitudinally of the car, a second side sheet portion distinct from said first arcuate side sheet portion and extending continuously and longitudinally of the car, said second side sheet portion being substantially flatter in cross section than said first arcuate side sheet portion and having upper and lower boundaries also extending longitudinally of the car, said second side sheet portion being positioned beneath and secured adjacent its upper boundary to said first arcuate side sheet portion adjacent the lower boundary of the first arcuate side sheet portion on the same side of the car, said second side sheet portion also defining the bottom of the side walls of the car, roof means covering the car and secured to said first arcuate side sheet portion on each side of the car adjacent the upper boundary thereof, and reinforcing means extending continuously and longitudinally on the exterior of the car and between the upper and lower boundaries of said second side sheet portion and reinforcing said second side sheet portion over its length.

2. The car of claim 1, wherein said second side sheet portions of each side wall are inclined such that their lower boundaries are closer to each other than their upper boundaries.

3. The car of claim 1, wherein said first mentioned reinforcing means comprise side sill means extending substantially continuously over the length of the car and secured to the exterior of said second side sheet portion.

4. The car of claim 1, including end slope sheet means and substantially vertical end wall means secured to the upper end of said end slope sheet means, center plate means for mounting a rail car truck at the end of the car, said first arcuate side sheet portion and second side sheet portion extending longitudinally toward an end of the car toward a vertical plane through said vertical wall means and beyond a vertical plane through said center plate means.

5. The car of claim 1, wherein said first arcuate side sheet and second side sheet portions are separate sheets, the boundaries of said sheets are edges, and the upper edge of said second side sheet portion is secured to said first arcuate side sheet portion adjacent its lower edge.

6. The car of claim 1, wherein said second side sheet portion is substantially flat in cross section.

7. The car of claim 6, wherein said second side sheet portions of each side wall are inclined such that their lower boundaries are closer to each other than their upper boundaries.

8. The car of claim 1, including second reinforcing means comprising longitudinally, continuously extending longeron means secured to both said first arcuate side sheet portion and said second said sheet portion adjacent the location that said first and second side sheet portions are secured to each other.

9. The car of claim 8, wherein said first arcuate side sheet and second side sheet portions' boundaries are defined by edges, and said longeron means is on the exterior of said car and is formed integrally with said second side sheet portion by bending the upper edge of said second side sheet portion toward the exterior of said first arcuate side sheet portion adjacent the lower edge of said first arcuate side sheet means.

10. The car of claim 8, wherein first mentioned reinforcing means comprise side sill means extending substantially continuously over the length of the car and secured to the exterior of said second side sheet portion.

11. The car of claim 1, wherein said roof means are arcuate in cross section, and longitudinally continuously extending upper longeron means secured to both said first arcuate side sheet portion and said roof means adjacent the location that said roof means are secured to said first arcuate side sheet portion.

12. The car of claim 11, wherein said upper longeron means are formed integrally with said roof means by bending said roof means edges toward the exterior of said first arcuate side sheet portion adjacent the upper boundary of said first arcuate side sheet portion.

13. A covered railway hopper car comprising:

side walls on opposite sides of the car and having a top and bottom, said side walls each including, a first arcuate side sheet portion extending longitudinally of the car and having upper and lower boundaries also extending longitudinally of the car;

a second side sheet portion extending continuously and longitudinally of the car, said second side sheet portion being substantially flatter in cross section than said flate arcuate side sheet portion and having upper and lower boundaries also extending longitudinally of the car, said second side sheet portion being positioned beneath and secured adjacent its upper boundary to said first arcuate side sheet portion adjacent the lower boundary of the first arcuate side sheet portion on the same side of the car, said second side sheet portion also defining the bottom portion of the side walls of the car;

roof means covering the car and secured to said first arcuate side sheet portion on each side of the car adjacent the upper boundary thereof;

reinforcing means extending longitudinally of the car and reinforcing at least one of said first arcuate side sheet portion and said second side sheet portion; and end slope sheet means and substantially vertical end wall means secured to the upper end of said end slope sheet means, horizontal shear plate means at an end of the car, center plate means for mounting a rail car truck at the end of the car, said center plate means being secured to said shear plate means beneath said end slope sheet means and in a vertical plane which intersects said end slope wall means at a location substantially intermediate the top of said end slope wall means and the location that the horizontal plane of said shear plate intersects said end slope wall means, first vertical support means extending substantially vertically between and secured to said shear plate means and said end slope wall means in said vertical plane, and second vertical support means extending upwardly adjacent said vertical plane between said end slope sheet means and said roof means, whereby forces are transmitted in said vertical plane from said center plate means to said roof means to a location at said roof means spaced from said vertical end wall means and substantially adjacent said vertical plane.

14. The car of claim 13, including gusset means extending longitudinally of said car and secured to said first support means, said shear plate means and said end slope sheet means.

15. The car of claim 13, wherein said first arcuate side sheet portion and second side sheet portion extend longitudinally toward an end of the car toward a vertical plane through said vertical wall means and beyond said first-mentioned vertical plane, whereby said first arcuate side sheet portion and said second side sheet portion also transmit forces directly to said roof means.

16. The car of claim 15, wherein said second side sheet portions are substantially flat in cross section and are inclined such that their lower boundaries are closer to each other than their upper boundaries, said reinforcing means including longitudinally continuously extending longeron means on the exterior of the side walls of the car substantially intermediate the upper and lower boundaries of said first arcuate side sheet portion and second side sheet portion respectively, said longeron means being secured to both said first arcuate side sheet portion and said second sheet portion adjacent the location that said first and second sheet portions are secured to each other, said reinforcing means also include side sill means extending substantially continuously over the length of the car and secured to the exterior of said second side sheet portion between its upper and lower boundaries, said roof means are arcuate in cross section, and longitudinally continuously extending upper longeron means secured to both said first arcuate side sheet portions and said roof means adjacent the location that said roof means are secured to said first arcuate side sheet portions.

17. The car of claim 16, wherein said first arcuate side sheet and second side sheet portions' boundaries are defined by edges, and said longeron means of said reinforcing means is on the exterior of the car and is formed integrally with said second side sheet portion by bending the upper edge of said second side sheet portion toward the exterior of said first arcuate side sheet portion adjacent the lower boundary of said first arcuate side sheet portion.

18. The car of claim 16, including gusset means extending longitudinally of said car and secured to said first support means, said shear plate means and said end slope sheet means.

19. A covered railway hopper car having side walls, and an end slope sheet having upper and lower ends, a vertical end wall secured to the upper end of the end slope sheet, a roof, side sills, a substantially horizontal generally planar shear plate at an end of the car extending between the side sills, a center plate for mounting a rail car truck at the end of the car, the center plate being secured to the shear plate beneath the end slope sheet and in a vertical plane which intersects the end slope sheet at a location substantially intermediate the upper end of the end slope sheet and the location that the plane of the horizontal shear plate intersects the end slope sheet, the improvement therein comprising:

first vertical support means extending vertically between and secured to said shear plate and said end slope sheet in said vertical plane, and second vertical support means extending upwardly adjacent said vertical plane between said end slope sheet and said roof, whereby forces are transmitted subsantially in said vertical plane directly to said roof at a location spaced from said vertical end wall.

20. The car of claim 19, including gusset means extending longitudinally of said car and secured to said first support means, said shear plate and said end slope sheet, and inclined plate means secured to the end of said gusset means opposite said first support means and extending transversely of the car.

21. The car of claim 19, including gusset means extending longitudinally of said car and secured to said first support means, said shear plate and said end slope sheet.

22. The car of claim 19, wherein said first vertical support means comprises a substantially vertical plate extending transversely of the car and secured to the side walls, shear plate and end slope sheet.

23. The car of claim 19, wherein said side walls extend longitudinally toward the end of the car toward a vertical plane through said vertical wall and beyond said first-mentioned vertical plane, whereby said side walls also transmit forces directly to said roof.

24. The car of claim 23, wherein said first vertical support means comprises a substantially vertical plate extending transversely of the car and secured to the side walls, shear plate and end slope sheet and, gusset means extending longitudinally of said car and secured to said first support means, said shear plate and said end slope sheet.

* * * * *

UNITED STATES PATENT AND TRADEMARK OFFICE

CERTIFICATE OF CORRECTION

PATENT NO. : 4,484,528
DATED : November 27, 1984
INVENTOR(S) : Arthur I. Anderson
Louis J. Harvatin It is certified that error appears in the above-identified patent and that said Letters Patent are hereby corrected as shown below:

In the Abstract, line 13, delete "of" (first occurrence) and insert --on--.

In Col. 1, line 54, delete "comlexity" and insert --complexity--.

In Col. 7, line 33, delete "flate" and insert --first--.

Signed and Sealed this

*Fourth* Day of *June 1985*

[SEAL]

*Attest:*

DONALD J. QUIGG

*Attesting Officer* *Acting Commissioner of Patents and Trademarks*